United States Patent [19]

Apelt et al.

[11] 4,210,976

[45] Jul. 8, 1980

[54] ARRANGEMENT FOR REMOVING THE SLAG INCRUSTATIONS ON MELTING AND CASTING VESSELS

[75] Inventors: Heinz Apelt, Roetgen, Fed. Rep. of Germany; Helmut Packes, Kettenis, Belgium

[73] Assignee: Otto Junker GmbH, Simmerath, Fed. Rep. of Germany

[21] Appl. No.: 908,246

[22] Filed: May 22, 1978

[30] Foreign Application Priority Data

May 25, 1977 [DE] Fed. Rep. of Germany ..... 2723547

[51] Int. Cl.[2] ..... B08B 1/04

[52] U.S. Cl. ..... 15/246.5; 15/104.1 C

[58] Field of Search ..... 134/8; 15/93 R, 93 A, 15/246.5, 104.1 C; 266/135

[56] References Cited

U.S. PATENT DOCUMENTS

| | | | |
|---|---|---|---|
| 1,676,389 | 7/1928 | Fletcher | 15/104.1 C |
| 2,181,306 | 11/1939 | Osborn | 134/8 UX |
| 3,199,575 | 8/1965 | Keller | 15/246.5 X |
| 3,679,477 | 7/1972 | Zimmer | 134/8 |
| 3,848,289 | 11/1974 | Bachman | 15/246.5 |
| 4,095,307 | 6/1978 | Brubaker | 15/246.5 |

FOREIGN PATENT DOCUMENTS

| | | | |
|---|---|---|---|
| 425676 | 10/1974 | U.S.S.R. | 134/8 |

*Primary Examiner*—Richard V. Fisher

*Attorney, Agent, or Firm*—Michael J. Striker

[57] ABSTRACT

The device for removing incrustations from the inner wall of a cylindrical vessel comprises a driven shaft supported for rotation in the vessel about its central axis and for a vertical movement along this axis. Impact tools, preferably in the form of prismatic blocks defining a straight edge, are attached respectively to the shaft by a pair of chains in such a manner that the abrading edge of each tool extends parallel to the central axis when the chains are straightened by the centrifugal force.

17 Claims, 4 Drawing Figures

ARRANGEMENT FOR REMOVING THE SLAG INCRUSTATIONS ON MELTING AND CASTING VESSELS

BACKGROUND OF THE INVENTION

The invention relates to a method and an arrangement for removing the slag incrustations as well as possibly also the inner marginal layers infiltrated by metal or metal oxides, on the refractory inner lining, particularly ceramic lining, of melting or casting vessels which are at least internally cylindrical over the substantial part of their length.

During the operative use of such vessels, slag deposits on the internal walls of the lining which come into contact with the molten material. Not only can these slag incrustations become so thick that they considerably reduce the volumetric capacity of the vessels, but also they cause, and especially in induction heated vessels, a considerable reduction in the melting output so that the manufacturing operation is sensibly interfered with. Therefore, it is necessary to remove these slag incrustations from time to time.

These operations are performed predominantly manually, using special tools and requiring heavy physical exertion on the part of the operating personnel. Herein, such operations are preferably carried out with the vessel in hot condition inasmuch as the slag incrustations can be more readily removed under these conditions. However, the worker discomfort due to the heat is very great when resort is had to this operating procedure. While it is true that the removal of the incrustations is more difficult in the cold state of the vessels, the discomfort resulting from the heat which is radiated from the vessel interior is avoided under these conditions. Whether operations are carried out in the cold or in the hot condition of the vessel, however, the wear of the cleaning tools which have been heretofore used for this purpose is very high.

It would be conceivable to perform the removal of the slag incrustations mechanically by drilling or boring as it is known, for instance, for the renewal of the refractory lining in melting vessels. However, even disregarding the fact that the wear of the drilling tools is very high even here because of the extremely hard and brittle slag incrustations, a special problem exists here which resides in the fact that the slag incrustations or deposits do not have any uniform thickness, but rather that this thickness considerably varies both in the circumferential direction of the vessels as well as over their internal height. When it is desired not to run the danger that the drilling tools which, for the most part, also consist of a brittle material, would break due to too high impact stressing, it is necessary, in a very expensive and time-consuming manner, to begin with the smallest possible boring radius and to gradually increase the same in the course of several passes.

Because of the high machinery, time or labor expenditure and the high susceptibility of the boring apparatus to malfunction, which are encountered when the above approach is taken, all attempts to remove the slag incrustations in this manner have failed in the practice so that it remained by the, however also laborious, manual removal of the slag incrustations by means of special tools.

On top of this, what is common to both of these methods is that the danger exists to a high degree that, during the removal of the slag incrustations as well as the possible erosion of the inner marginal layers of the ceramic inner lining which have been infiltrated by metal or metallic oxides, even the unused lining material as well as, under certain circumstances, even the vessel masonry itself, are damaged.

SUMMARY OF THE INVENTION

It constitutes a task of the invention to provide a method and an arrangement which render it possible to remove the slag incrustations as well as possibly also the inner marginal layers of the inner lining of melting or casting vessels of the initially described type, which have been infiltrated by metal or metallic oxides, while by using machinery, still in a substantially shorter period of time, more efficiently and also simultaneously in a more sparing manner.

To solve this problem, the method of the invention is characterized in that the slag incrustations or infiltrated marginal layers are abraded by means of tools which hit and scrape the same, utilizing tangential rotary impulses. Preferably, this occurs in such a manner that the removal of the slag incrustations and infiltrated marginal layers is achieved by means of abrading tools which rotate in the interior of the vessel and which simultaneously are longitudinally moved, either in a continuous or in a stepwise manner, in the axial direction of the vessel, being radially as well as tangentially flexibly guided and, consequently, acting on the internal wall of the lining by radial and tangential impact.

It has been surprisingly established that, in this manner, it is possible to so fully and uniformly remove even very differently thick and, additionally, extremely hard and brittle slag incrustations, usually in only one vertical traverse and in a very short period of time, that cumbersome aftertreatments by hand can be avoided. This is true not only for the removal of the slag incrustations, but also for the abrasion of the inner marginal layers of the lining which have been infiltrated by metal or metallic oxides, and this without having to fear that the still sound lining material would suffer damage, or break out.

As a result of the fact that the abrading tools are flexibly guided, both radially as well as tangentially, they can act during their orbiting movement along the inner circumference of the lining on the rigid incrustations, especially on thick and hard incrustations, with a high kinetic energy indeed correspondingly to their high tangential rotary impulse, but they also partially give way and remove the same only gradually in the course of the following orbiting movements, in this manner. This operating procedure has the considerable advantage, especially as compared to the boring of the slag incrustations, that the abrading tools, on the one hand, cannot seize and that they, on the other hand, spare the vessel wall. Break-outs, cracks or the like did not occur or have not been observed during the use of the method acccording to the invention.

A further advantage of the method according to the invention resides in that that not only the slag incrustations, but also the inner marginal layers of the lining which have been, to a greater or lesser degree, infiltrated with metal or metallic oxides, can be abraded in a uniform manner and in the single vertical traverse, without destroying or impairing still intact regions of the lining which are situated behind these marginal layers.

The invention is primarily based on the recognition of the fact that the abrading tools, which rotate in the vessel interior and which are radially as well as tangentially flexibly guided, operate the more efficiently the harder and more brittle the slag incrustations or the inner marginal layers of the lining which are infiltrated with metal or metallic oxides are and that, on the other hand, the still intact lining material which is softer as compared to the slag, is spared.

A further significant advantage of the method of the invention resides in the fact that the radial operating region of the radially as well as tangentially guided flexible abrading tools can be pre-determined or adjusted, partially in dependence on the speed of rotation and partially in dependence on the limitation of their radial flexibility, in such a manner that it is possible, with respect to a predetermined inner vessel diameter, to leave them, by and large, to themselves independently on the thickness and irregularity of the inner slag incrustations. While they, to a certain extent, "trail" when the slag incrustations are thick at the beginning of the eroding operation, in the direction of rotation or tangentially to the direction of rotation, and perform the more effective hitting work, the predetermined limitation of their radial flexibility, possibly in connection with a corresponding increase in the speed of rotation, automatically results in that they, owing to the centrifugal forces, change from the initially predominantly striking to a more scraping mode of operation with the increasing degree of abrasion and finally, after the substantial abrasion even of the inner marginal layers of the lining which have been infiltrated with metal or metal oxides, they work only in a grinding mode of operation. A damage to, or even destruction of the still intact regions of the lining lying behind the same is securely avoided in this manner, and it is simultaneously assured that the inner surface of the remaining lining will come out completely smooth and concentric. The abraded layer, as a result of this, can be easily and unproblematically replaced, in a conventional manner, by a coating of a fresh ceramic material, without running into additional and cumbersome repair operations prior to the same.

While it is often advantageous to operate at a lower speed of rotation at the beginning of the abrading operation in dependence on the centrifugal mass of the abrading tools, it is recommended to gradually increase the same, preferably in a stepless manner. At a centrifugal mass of the abrading tools in the order of magnitude of upto approximately 20 kg, it has been established to be advantageous to operate at a speed of orbiting amounting to at least approximately 4 m/sec, however, at most upto approximately 15 m/sec, wherein the suitable selection of the speed of rotation as well as of the centrifugal mass of the abrading tools depends, however, to a great degree, on the character or the rigidity and brittleness of the slag incrustations as well as of the infiltrated marginal layers, so that they can possibly be empirically optimized.

The abrading tools are simultaneously moved, during their orbiting motion, relative to the inner wall of the vessel parallel to its longitudinal axis at a speed which is relatively low in comparison to the orbiting motion, being between approximately 0.01 and 0.5 m/sec. Under these circumstances, it is sufficient, as a rule, to let the abrading tools pass through the vessel interior and over its height, only once from below to above, and it is not necessary to repeat this traverse in the opposite direction of movement.

It has further been proved to be advantageous to perform the abrasion of the slag incrustations and infiltrated marginal layers on the hot internal wall of the vessel lining, for which the vessel, or at least the internal wall of the vessel lining, must possibly be heated during the abrading operation. It has been found to be advantageous to maintain the vessel lining, during the abrading operation, depending on the composition of the slag and/or the type of metals or metallic oxides infitrated into the inner marginal layers—possibly by afterheating or additional heating—at a temperature between approximately 300° and 1400° C., preferably between 600° and 1200° C. In this manner, the time needed for the abrading operation can be significantly shortened and, on the other hand, the wear-dependent durability of the abrading tools can be increased to a not insignificant degree. While the low temperature values are contemplated mainly for vessels for light-metal melts, such as, for instance, aluminum or aluminum alloys, the higher temperature values are meant more for vessels for iron-metal or steel melts.

A device for performing the method includes, in accordance with the invention, a driven rotary body which is centrally introducible into the vessel and the radial position of which relative to the same is fixed by its bearing means. The vertical position of the body is adjustable along the central axis of the vessel and over the height of the internal wall. The body is provided with a plurality of abrading tools that are uniformly arranged about its periphery and are secured thereto for a limited movement in radial and tangential directions by flexible links.

The abrading tools advantageously consist of blocks, preferably of metal, which are elongated in direction parallel to the central axis and are configurated with edges at least at their longitudinal side which faces the internal lining of the vessel. According to a preferred further development, the abrading tools consist of substantially prismatically configurated steel blocks having rectangular or square cross-sectional shape.

These eroding tools are connected with the rotary body flexibly at least in the radial plane and the flexible connecting means have a length which delimits the predetermined radial range of attack of the abrading tools on the internal wall.

The connecting means between the rotary body and the abrading tools can include, for example, leaf springs, but they are preferably constructed as chains, especially in the form of link or side-bar chains. Herein, an especially preferred further development resides in that the abrading tools are respectively connected to the rotary body by means of at least two chains arranged at an axial distance from one another, that they hold the abrading edge of the tools during their orbiting or rotational movement along the inner circumference of the vessel lining in an operating position approximately parallel to the central vessel axis.

The rotationally symmetrical rotary body is configurated substantially to a disk shape in the plane transverse to the central axis of the vessel and is provided at its outer periphery, symmetrically distributed over the same, with at least three abrading tools hanging thereon with the interposition of the flexible connecting means.

In a simple embodiment, the rotary body is shaped as a rotary cross. In order to be able to fit the arrangement to vessels having different inner diameters, it is advantageous to make the arms of the rotary cross adjustable, for instance telescopically, whereby the flexible connecting means for the abrasion tools are affixed to their free ends.

According to another preferred further development of the invention, the rotary body consists of two disks which are arranged at a distance one above the other and between which there are mounted, uniformly distributed over the periphery, for pivoting in the radial plane, by means of bearing sleeves, outwardly pointing carrier arms which are provided at their outer ends with the flexible connecting means for the connection of the abrading tools. The carrier arms can be curved or angled at least in the radial plane counter the direction of rotation and possibly also be vertically offset with respect to one another. The latter arrangement is recommended especially when the rotary body has, distributed over its periphery, more than 4, for instance, 6 or 8, carrier arms for the abrading tools, in order to increase the productivity of the arrangement in this manner.

An adjustment of the carrier arms for varying or fitting the range of the radial attack of the abrading tools hanging on them is also possible and advantageous even in this exemplary embodiment. This is achieved, for instance, advantageously in that the carrier arms are tiltable out of their substantially radial normal position, preferably against the direction of rotation and are arrestable in their respective tilted position.

In order to be able to jointly and uniformly adjust all of the carrier arms by means of a shared adjusting arrangement, it is advantageous in accordance with an expedient further development of the invention, to provide an adjusting arrangement which consists, on the one hand, of an endless chain which couples sprocket wheels, which are rotationally associated with the bearing sleeves of the carrier arms, with one another in the rotating sense and, on the other hand, of a further toothed wheel which is connected with an arrestable adjustment drive and is at least mediately coupled with the endless chain in the rotating sense.

The rotary body which carries the abrading tools may be suspended, in a simple manner, by means of a driving shaft that is coaxial with the central vessel axis, from a carrier frame which is supported either on the edge of the vessel itself or, by means of a scaffolding, on the floor next to the vessel, while means for the vertical adjustment of the bearing as well as for the rotary drive of the driving shaft are supported on the carrier frame.

The means for the vertical adjustment of the bearing of the driving shaft can consist, for example, of a spindle drive immediately cooperating with the driving shaft or—preferably—of a hydraulic cylinder-and-piston unit by means of which the bearing bracket which carries the driving shaft is shiftable within a vertical sliding guide of the carrier frame. Under the circumstances, this can be accomplished also by means of the available hall crane.

The driving aggregate for the rotary drive of the driving shaft is preferably constituted by a steplessly controllable motor, particularly a compressed air motor, the pinion of which advantageously directly meshes with a gear ring of the driving shaft.

In this connection, an especially advantageous form of an embodiment results when the driving shaft for the rotary body is configurated as a hollow shaft which accommodates in its axial center the adjusting linkage for the adjustment drive of the carrier arms that are tiltable in the radial plane. Then, the adjustment linkage that axially passes through the hollow driving shaft is provided, at the upper end, outwardly of the driving shaft, with a tilting lever which is arrestable in its respective position by means of detents, abutments or the like which rotate together with the driving shaft. Then, expediently, the adjustment linkage carries at its lower end the toothed wheel for the common adjustment of all of the carrier arms. The adjustment is effected by means of an endless chain which is also in engagement with a further toothed wheel of one of the bearing sleeves of the carrier arms.

In the following, two preferred embodiments of the invention are described in connection with the drawing.

DESCRIPTION OF THE PREFERRED EMBODIMENTS

Figure 1:
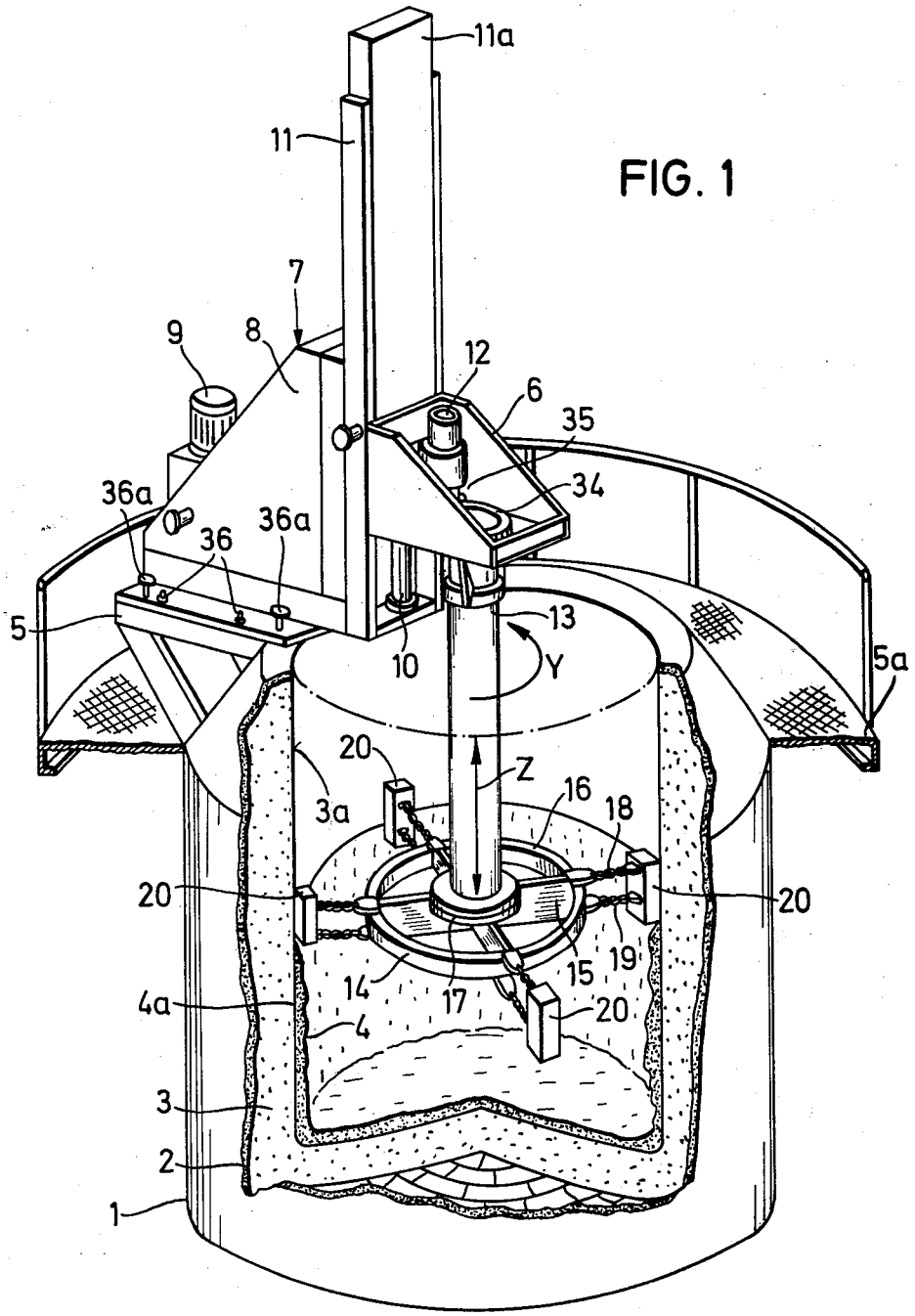
FIG. 1 is an embodiment of the device of this invention during the operation in a melting vessel, shown in a perspective, partially sectioned view.

In FIG. 1, the crucible-shaped melting vessel, which can be heated in a non-illustrated manner, is indicated with 1. It consists of a metallic outer wall 2 and a ceramic lining 3 which adjoins the same inwardly and which is burdened after a longer use in the melting and casting operation at the internal wall 3*a* with slag incrustations 4. Additionally, the inner marginal layers of the lining, which are infiltrated by metal or metallic oxides, are indicated by 4*a*.

The melting vessel 1 is provided at its upper edge region with a walking operating platform 5*a* for the operating personnel.

At the level of the upper edge of vessel 1, a metallic frame 5 is attached at the outer wall 2, which serves for the support of the carrier frame 7 for the abrading device. The carrier frame 7 includes an oil pump 9 which is connected to an oil container 8, and a hydraulic cylinder-and-piston unit 10 that is connected thereto, which is coupled at its free end with a sled 11*a* which is shiftably guided in a vertical sliding guide 11.

A bearing bracket 6 is affixed to the vertically movable sled 11*a*.

The bearing bracket 6 serves, on the one hand, for the accommodation and bearing of the driving shaft 13 which is configurated as a hollow shaft and, on the other hand, for the accommodation of a steplessly controllable compressed air motor 12 the pinion 35 of which directly meshes with a gear ring 34 at the upper end of the driving shaft 13.

At the lower end of the driving shaft 13 which is, in this manner, guided centrally within the melting vessel 1 in direction of the arrows Z for vertical shifting, there is provided a flange 17 which serves for the connection of a rotary cross serving as rotary body. The four arms 15 of the rotary cross are connected at the outer periphery by means of a profiled ring 16. At the outer periphery of the profiled ring, there are respectively connected in the region of the arms 15, pairs of chains 18 and 19 at the free ends of which the abrasion tools 20 are provided. The chains 18 and 19 are configurated as side-bar chains, link chain or roller chains so that the abrasion tools 20 which are affixed to their ends are to a certain limit radially as well as tangentially yieldable or movable in the radial plane of the rotary body 15, 16.

As is evident from FIG. 1, the chains 18 and 19 have such lengths that the radial attack region of the abrading tools, when they are fully extended radially under the influence of the centrifugal force, is limited to the radial depth of that marginal layer which is still penetrated or infiltrated by metal or metallic oxides an thus is to be abraded.

The abrading tools 20 consist of substantially prismatic, edged steel blocks with a rectangular or square cross section.

In order to be able to fit this embodiment to different inner diameters of the vessel, it is possible to make the arms 15 of the rotary cross adjustable in length, for instance telescopically. Instead, merely the chains 18 and 19 can be exchanged for correspondingly shorter or longer chains.

Figure 2:
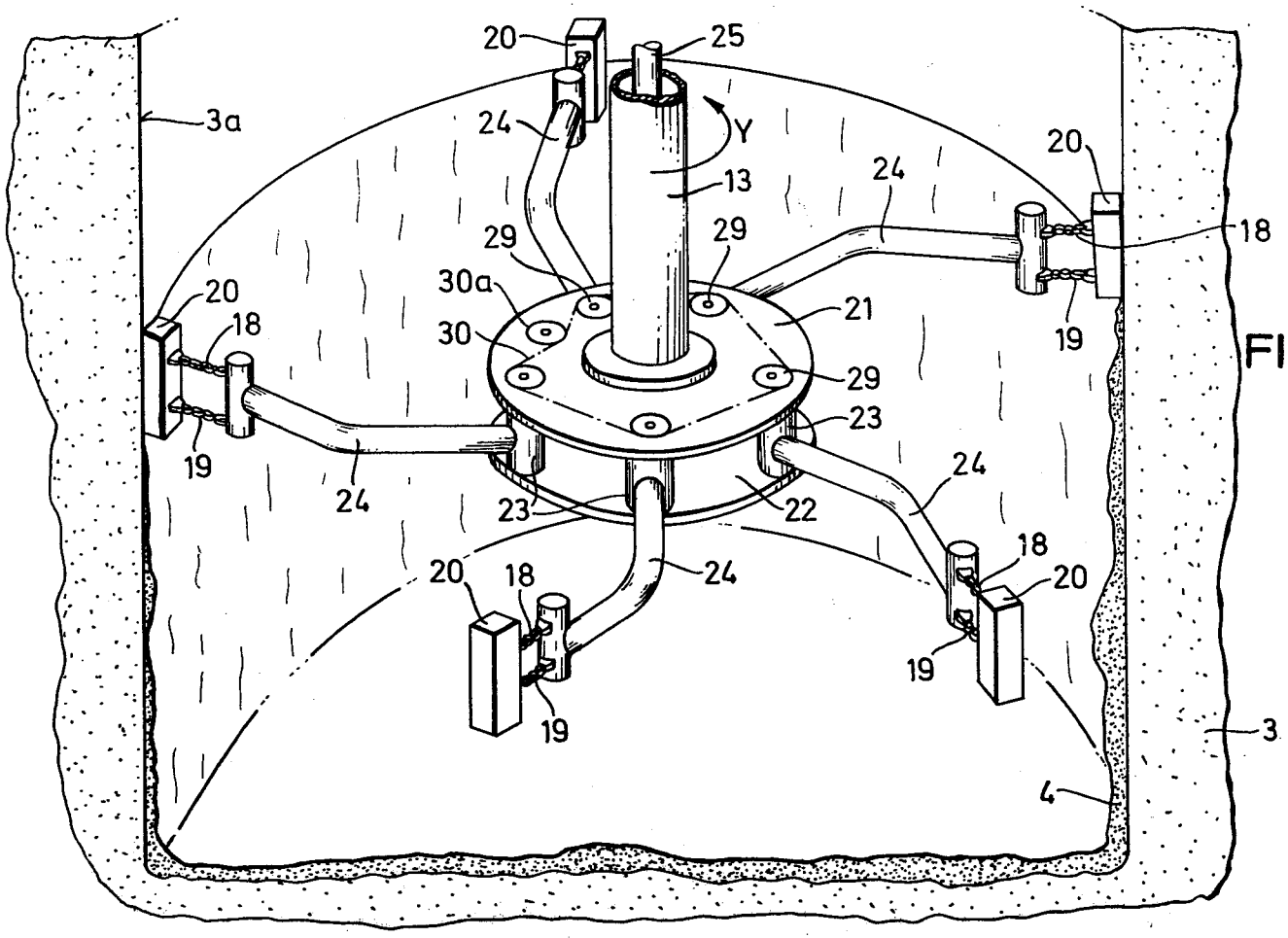
FIG. 2 is a fragmentary and longitudinally sectional view of a melting vessel with a further embodiment of the device of this invention.
Figure 3:
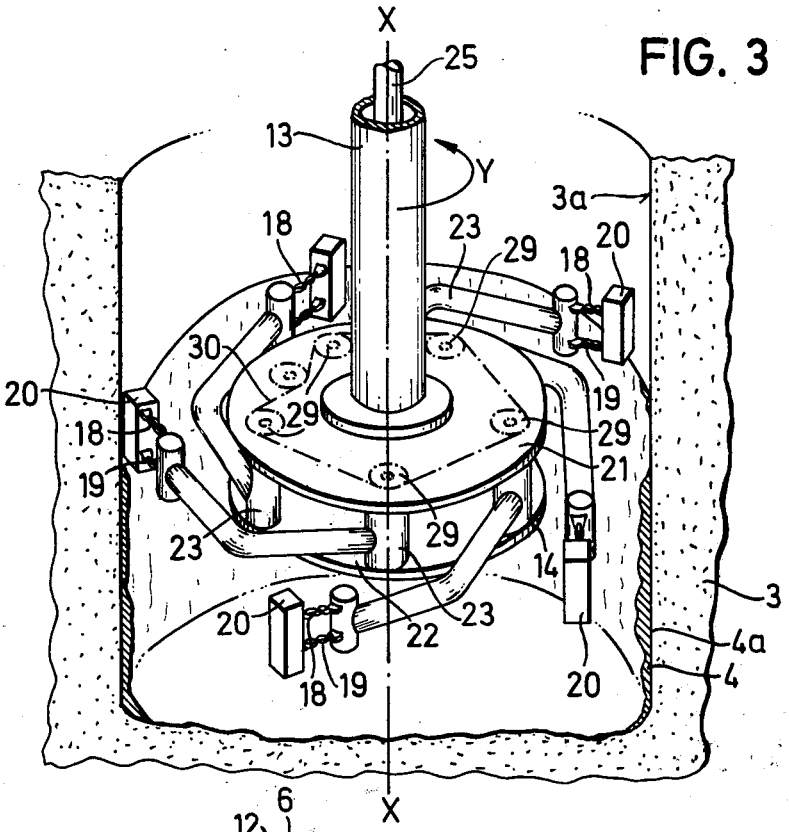
FIG. 3 is the device according to FIG. 2 during use in a melting vessel of a smaller diameter and FIG. 4 is a diagrammatic longitudinal section of the of the melting vessel with the embodiment of the device according to FIGS. 2 and 3.
Figure 4:
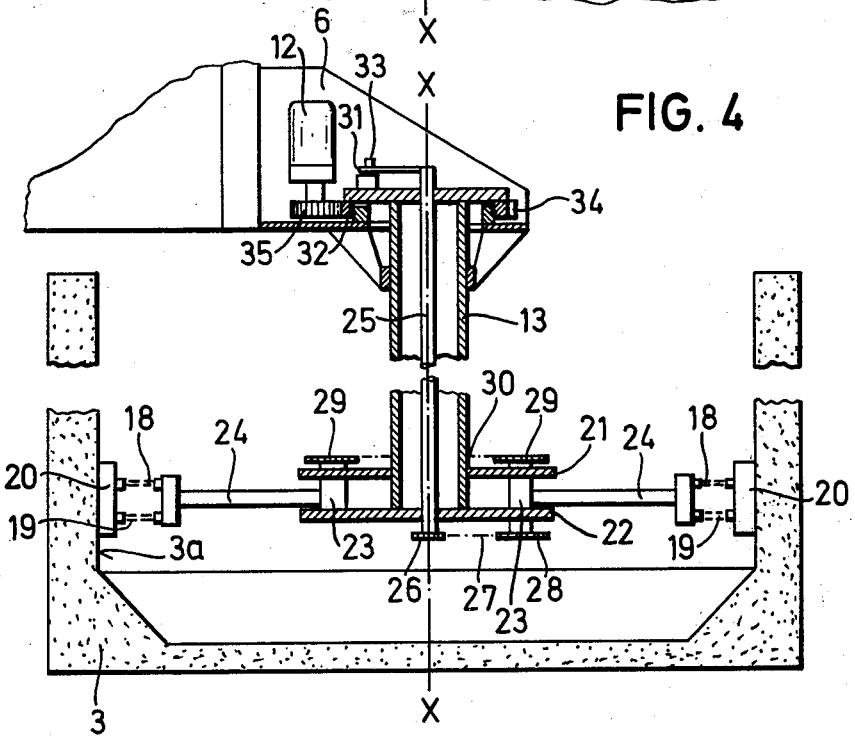

The embodiment of the eroding arrangement according to FIGS. 2, 3 and 4 differs from the previously described substantially by the changed configuration of the rotary body.

This embodiment consists of two circular steel plates or disks 21 and 22, between which carrier arms 24 are supported by means of bearing sleeves 23 for pivoting in the radial plane. In the illustrated embodiment, five of such carrier arms are arranged in this manner, being distributed over the periphery at uniform spacings. At the free ends of the carrier arms, which are angled or curved against the direction of rotation Y, there are again affixed by means of the chain pairs 18, 19 the abrading tools 20.

This pivotable mounting of the carrier arms 24 in the radial plane of the rotary body 21, 22 serves the purpose of fitting the radial range of attack of the slag abrading device to vessels with a different inner diameter. For this purpose, the bearing sleeves 23 of the carrier arms 24 are provided with sprocket wheels 29, which are commonly engaged by an endless gear chain 30. In order to maintain the chain 30 at a sufficient tension, there is provided an adjustable or spring-biased tensioning roller or toothed wheel 30*a* (compare FIG. 2).

As may especially be ascertained from FIG. 4, the hollow driving shaft 13 has an adjustment linkage 25 passing therethrough, which at its lower end carries a toothed wheel 26. The wheel 26 is coupled via a further endless chain 27 for rotation with the toothed wheel 28 at the opposite lower end of one of the bearing sleeves 23 for the carrier arms 24. At the upper end which extends beyond the hollow driving shaft, the adjusting linkage 25 is provided with a tilting lever 31 which is arrestable in the respective tilting positions by means of abutments 33. In this manner, the arrested position of the carrier arms 24 can be varied to fit different inner diameters of the vessel.

As appears from FIG. 4, the arresting abutment or abutments 33 for the tilting lever 31 are affixed to the upper side of a flange-shaped covering plate 32 which rotates with the driving shaft 13, and by means of which the driving shaft 13 possibly bears on an axial roller bearing, and underneath which the toothed ring 24 for the rotary drive of the driving shaft by means of the compressed air motor is arranged.

The above-described abrading device has been sucessfully employed, for testing purposes, in a melting vessel having an inner diameter of approximately 1 m and at a temperature of the lining of approximately 800° C. Herein, steel blocks having a weight of 16 kg each have been used as abrading tools. In this arrangement, the rotary body which has been provided with the abrading tools has been brought, by means of the driving shaft, into the vicinity of the vessel bottom and, thereafter, set into rotational movement by activating the compressed air motor. The originally low orbiting speed was then gradually increased upto a value of approximately 5.3 m/sec. After that, the arrangement has been raised, at a speed of approximately 160 mm/sec, commencing at the vessel bottom, and removed from the melting vessel again after a single stroke. The inner surface of the vessel lining, on which before the treatment slag incrustations having a thickness of 100 mm and more adhered, was thereafter centrical as well as fully smooth and free of any incrustations and inner marginal portions infiltrated by metal or metallic oxides. In a vessel having an inner height of 1.2 m, the whole operation lasted a surprisingly short time of approximately 11 minutes only.

The special advantage of the arrangement of the invention resides, moreover, in the fact that it requires only a relatively modest expenditure in the construction of the apparatus, is simple and rugged and can be easily fitted to different diameters of the treated vessel. In the event of wear of the abrasion tools their replacement takes place without incurring any labor and time expenses worth mentioning.

In order to be able to fit the arrangement to different inner diameters of the vessel with respect to the centrical arrangement of the driving shaft 13 or of the rotary body, the carrier frame 7 can be radially shiftable on a guiding plate of the metallic support frame 5 and arrestable, for example, by means of plug-in holes and plug pins 36, 36*a*, in the desired radial position.

What is claimed as new and desired to be protected by Letters Patent is set forth in the apended claims:

1. A device for removing incrustations from the inner wall surface of a cylindrical vessel defining a central axis, comprising a driven body; means for mounting said body on a vessel so that said body rotates about said axis and is movable lengthwise of the same while being prevented from movement transversely of said axis; a plurality of impact tools spaced circumferentially about said body and each having a straight abrading edge adjacent the inner wall surface and a face directed towards said axis; and a pair of axially spaced flexible links of identical radial length for each of said impact tools and having inner ends connected to said body and outer ends connected to the respective face at locations thereof which are spaced lengthwise of said axis, such that the abrading edge of each impact tool is held along the inner circumference of the vessel lining in an operating position in which it extends approximately parallel to said axis during rotation of said body and beyond which it cannot approach the vessel lining in radial direction, so that the tool can remove deposits from the vessel lining but cannot damage the vessel lining itself.

2. The device as defined in claim 1, wherein said pairs of links with the assigned tools are regularly arranged in radial planes about the periphery of said body.

3. The device as defined in claim 1, wherein said impact tools are metallic blocks.

4. The device as defined in claim 3, wherein said blocks are rectangular prisms.

5. The device as defined in claim 1, wherein said links have adjustable length to delimit a desired radial range of attack of said tools against the lining of said vessel.

6. The device as defined in claim 1, wherein said flexible links are chains.

7. The device as defined in claim 1 further including a stationary carrier frame, vertically adjustable supporting means arranged on said carrier frame, a driving assembly including a driving shaft supported for rotation about said central axis on said adjustable supporting means and being connected at its free end to said driven body.

8. The device as defined in claim 7, wherein said vertically adjustable supporting means includes a sliding guide, a bearing bracket for said shaft movably supported in said guide and a hydraulic cylinder piston unit for vertically adjusting said bearing bracket.

9. The device as defined in claim 8, further including a driving motor arranged on said bearing bracket, and transmission gears between said driving motor and said driving shaft.

10. A device for removing incrustations from the inner wall of a cylindrical vessel defining a central axis, comprising: a driven body supported for rotation in said vessel about said axis and for vertical movement along said axis, said driven body being assembled of two discs arranged at a distance one above the other, a plurality of bearing sleeves uniformly arranged around the periphery of said discs and supported for rotation about respective axes parallel to said central axis, and outwardly extending arms secured to respective sleeves in a radial plane; a plurality of pairs of flexible links, the links of each pair being arranged in axial direction one above the other and being secured at one end thereof to the free ends of said arms; and a plurality of impact tools defining a straight abrading edge and being secured at points opposite said edge to the other ends of said pairs of links, such that the abrading edge of each impact tool is held along the inner circumference of the vessel lining in an operating position at least approximately parallel to the central axis during rotation of the body.

11. The device as defined in claim 10, wherein said arms are bent in the radial plane against the direction of rotation of said body.

12. The device as defined in claim 10, wherein said arms are vertically offset relative to each other.

13. The device as defined in claim 10 further including arresting means for arresting said arms in a predetermined angular position in said radial plane.

14. The device as defined in claim 13, further including an adjusting device for adjusting said angular position of said arms, said adjusting device including sprocket wheels supported for joint rotation on said bearing sleeve, an endless chain coupling said sprocket wheels, and an arrestable drive gear engaging said endless chain to adjust the angular position of said sprocket wheels.

15. The device as defined in claim 14, wherein said driven body is connected to a hollow driving shaft and further including adjusting linkage for controlling said adjusting device of said carrier arms, said adjusting linkage passing through said hollow shaft and cooperating with said arresting means.

16. The device as defined in claim 15, wherein said arresting means include a lever secured to the upper end of said adjustment linkage and stop members arranged on a bracket and cooperating with said lever to limit the angular position of said linkage.

17. The device as defined in claim 16, wherein said adjustment linkage includes a tooth wheel connected to the lower end of said adjustment linkage and coupled to said endless chain to adjust the angular position of said arms.

* * * * *